US011802671B2

(12) United States Patent
Lee

(10) Patent No.: US 11,802,671 B2
(45) Date of Patent: Oct. 31, 2023

(54) EMERGENCY LAMP

(71) Applicant: Je Woo Corporation, Ltd., Huizhou (CN)

(72) Inventor: Sung-Keun Lee, Huizhou (CN)

(73) Assignee: JE WOO CORPORATION, LTD., Huizhou (CN)

( * ) Notice: Subject to any disclaimer, the term of this patent is extended or adjusted under 35 U.S.C. 154(b) by 0 days.

(21) Appl. No.: 17/579,521

(22) Filed: Jan. 19, 2022

(65) Prior Publication Data

US 2023/0184400 A1 Jun. 15, 2023

(30) Foreign Application Priority Data

Dec. 15, 2021 (CN) ..... 202111528166.7

(51) Int. Cl.

| | |
|---|---|
| ***F21S 9/02*** | (2006.01) |
| ***F21V 29/70*** | (2015.01) |
| ***F21K 9/61*** | (2016.01) |
| ***F21V 3/06*** | (2018.01) |
| ***F21V 23/00*** | (2015.01) |
| ***F21V 31/00*** | (2006.01) |
| *F21Y 115/10* | (2016.01) |

(52) U.S. Cl.

CPC ..... *F21S 9/022* (2013.01); *F21K 9/61* (2016.08); *F21V 3/06* (2018.02); *F21V 23/009* (2013.01); *F21V 29/70* (2015.01); *F21V 31/005* (2013.01); *F21Y 2115/10* (2016.08)

(58) Field of Classification Search

CPC .... F21S 9/022; F21K 9/61; F21V 3/06; F21V 23/009; F21V 29/70; F21V 31/005; F21Y 2115/10

See application file for complete search history.

(56) References Cited

U.S. PATENT DOCUMENTS

| | | | | |
|---|---|---|---|---|
| 6,010,228 | A * | 1/2000 | Blackman | F21V 23/0442 362/802 |
| 6,969,181 | B1 * | 11/2005 | Bailey | F21V 7/0025 362/147 |
| 7,737,640 | B2 * | 6/2010 | Marques | H05B 47/29 315/86 |
| 8,858,006 | B2 * | 10/2014 | Lee | F21V 29/74 315/86 |

(Continued)

*Primary Examiner* — Tsion Tumebo

(74) *Attorney, Agent, or Firm* — MATTHIAS SCHOLL P.C.; Matthias Scholl

(57) ABSTRACT

An emergency lamp includes a housing assembly; a battery module; a control panel; a lighting assembly; a heat sink configured for heat dissipation for the lighting assembly; a light guide assembly; and a transparent cover. The battery module includes a bracket, a battery disposed on the bracket, and a cladding layer wrapping around the battery. The housing assembly is a hollow structure, and the battery module, the control panel, and the lighting assembly are disposed in the housing assembly. The light guide assembly is connected to the lighting assembly. The transparent cover is disposed on the housing assembly; a position of the transparent cover corresponds to that of the light guide assembly. The battery module is electrically connected to the control panel, and the lighting assembly is electrically connected to the control panel; and the housing assembly including a hole for fixing a waterproof joint.

10 Claims, 4 Drawing Sheets

(56) References Cited

U.S. PATENT DOCUMENTS

| | | | | |
|---|---|---|---|---|
| 9,080,747 | B1 * | 7/2015 | Hetrick | F21V 15/01 |
| 9,839,088 | B1 * | 12/2017 | Deaton | H05B 47/13 |
| 11,241,599 | B2 * | 2/2022 | Enk | A62C 37/04 |
| 2008/0231234 | A1 * | 9/2008 | Mah | F21L 4/08 320/138 |
| 2010/0247990 | A1 * | 9/2010 | Ugaji | H01M 4/134 429/94 |
| 2011/0195291 | A1 * | 8/2011 | Yokoyama | H01M 50/213 429/99 |
| 2012/0092183 | A1 * | 4/2012 | Corbett | G08B 7/066 340/815.4 |
| 2012/0105835 | A1 * | 5/2012 | Fuse | H01M 50/124 427/510 |
| 2013/0050996 | A1 * | 2/2013 | Holscher | H05B 45/56 362/372 |
| 2013/0170180 | A1 * | 7/2013 | Lee | F21V 29/74 362/92 |

* cited by examiner

EMERGENCY LAMP

CROSS-REFERENCE TO RELATED APPLICATIONS

Pursuant to 35 U.S.C.§ 119 and the Paris Convention Treaty, this application claims foreign priority to Chinese Patent Application No. 202111528166.7 filed Dec.15, 2021, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an emergency lamp.

An emergency lamp is a battery-backed lighting device that switches on automatically when a building experiences a power outage. Conventional emergency lamps focus on the effect of emergency lighting, and limited by its structure, the emergency lamps are difficult to adapt to different application environments, such as low temperature areas and wet conditions.

SUMMARY

An emergency lamp comprises a housing assembly; a battery module; a control panel; a lighting assembly; a heat sink configured for heat dissipation for the lighting assembly; a light guide assembly; and a transparent cover. The battery module comprises a bracket, a battery disposed on the bracket, and a cladding layer wrapping around the battery. The housing assembly is a hollow structure, and the battery module, the control panel, and the lighting assembly are disposed in the housing assembly; the light guide assembly is connected to the lighting assembly; the transparent cover is disposed on the housing assembly; a position of the transparent cover corresponds to that of the light guide assembly; the battery module is electrically connected to the control panel, and the lighting assembly is electrically connected to the control panel; and the housing assembly comprising a hole for fixing a waterproof joint.

In a class of this embodiment, the lighting assembly comprises a stand connected to the housing assembly and a light source disposed on the stand.

In a class of this embodiment, the housing assembly comprises a front shell, a rear cover, and a bottom support disposed on the rear cover and facing the front shell; the front shell comprises an inner wall and a plurality of elastic parts is disposed on the inner wall; the rear cover is connected to the front shell through the plurality of elastic parts; and the battery module is connected to the front shell.

In a class of this embodiment, the front shell comprises a test button and a light pipe; and the test button is connected to the control panel.

In a class of this embodiment, the front shell comprises a recess, and the lighting assembly, the light guide assembly, and the transparent cover are disposed in the recess.

In a class of this embodiment, the light guide assembly comprises a lens and a reflector both disposed on the stand; the lens covers the light source, and the reflector surrounds the lens.

In a class of this embodiment, the heat sink is a heat pipe, one end of the heat sink is connected to the lighting assembly, and the other end is connected to the housing assembly.

In a class of this embodiment, the battery module further comprises a quick coupler connected to the control panel, and the control panel comprises a connector connected to the quick coupler.

In a class of this embodiment, the emergency lamp further comprises a sensing module disposed on the housing assembly; the sensing module comprises a fastener detachably connected to the housing assembly, and a sensor connected to the fastener; and the housing assembly comprises a connection hole to receive the fastener.

In a class of this embodiment, the cladding layer is a heating and thermal insulation layer.

The following advantages are associated with the emergency lamp of the disclosure.

1. The battery module, the control panel, the lighting assembly, and the light guide assembly are disposed in the housing assembly, which ensures good lighting effect, and meets the installation and use requirements in different indoor and outdoor conditions or low temperature environments, with flexible use and wide application.

2. The battery module comprises a cladding layer wrapping around the battery. When alternating current is available, the electrothermal film heats the battery through the mains supply. In case of power failure, the battery supplies power to the electrothermal film and the electrothermal film directly heats the battery, so that the emergency lamp can be used in a temperature environment, for example, between −50° C. and 5° C.

3. The emergency lamp comprises a heat sink configured for heat dissipation for the lighting assembly, thus ensuring the illumination effect thereof 4. The light guide assembly can make full use of the light emitted by the lamp, increase the light emergence angle, thus providing a large installation space for the lamp.

5. The housing assembly comprises a hole for fixing a waterproof joint, so that the wiring can be carried out reasonably according to different use conditions.

Figure 1:
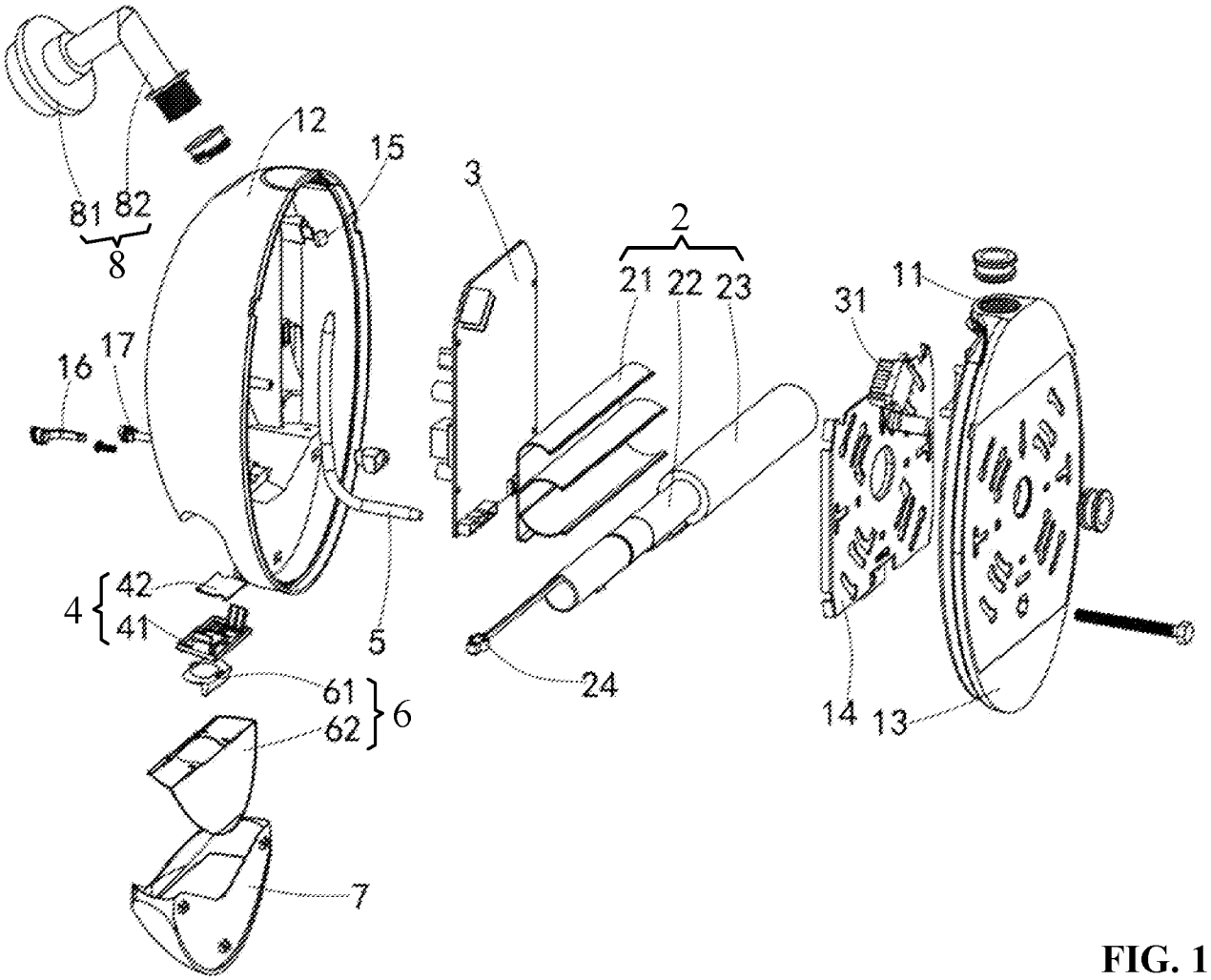
FIG. 1 is an exploded view of an emergency lamp in Example 1.
Figure 2:
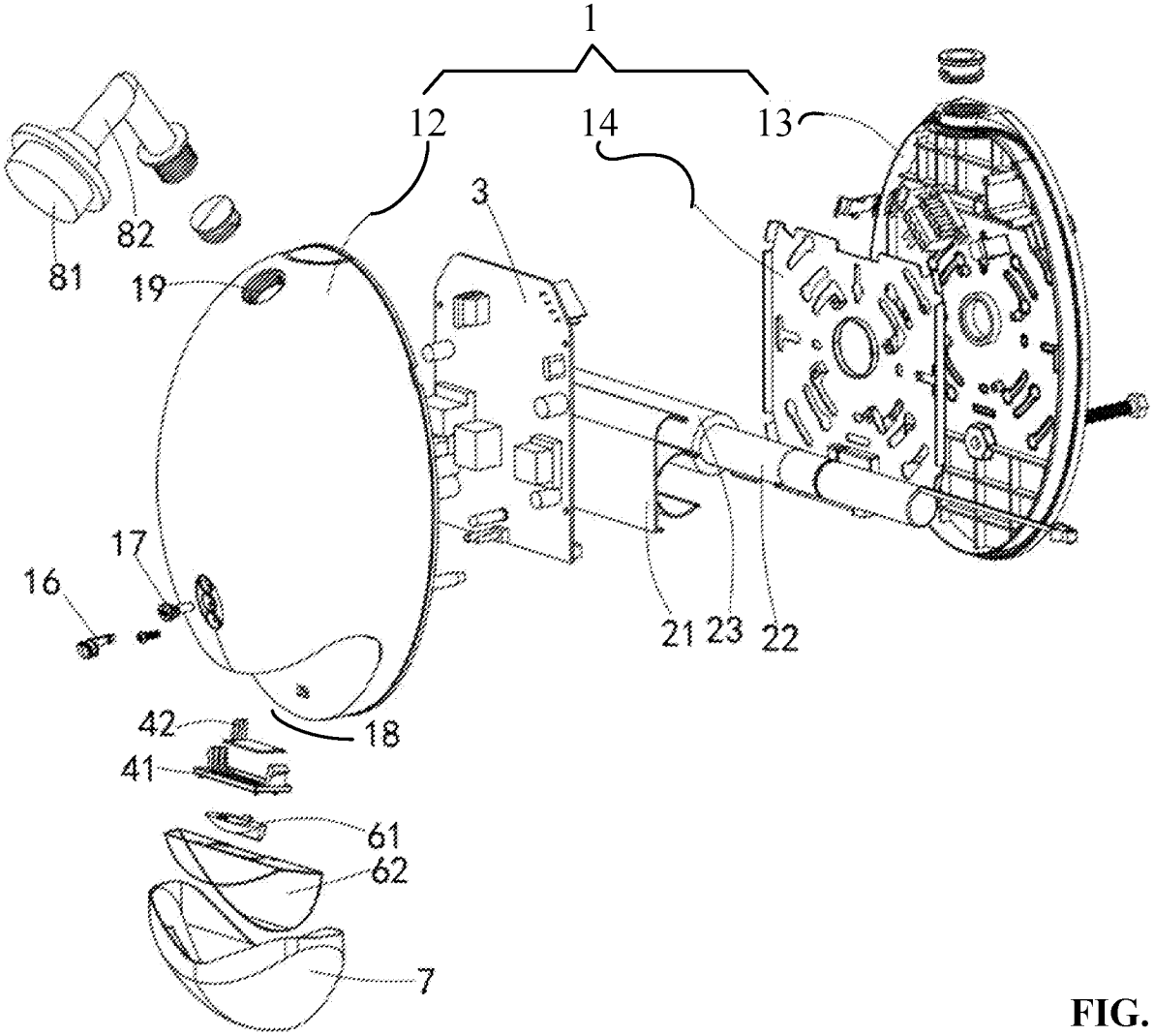
FIG. 2 is an exploded view of an emergency lamp in Example 1 in another angle of view.
Figure 3:
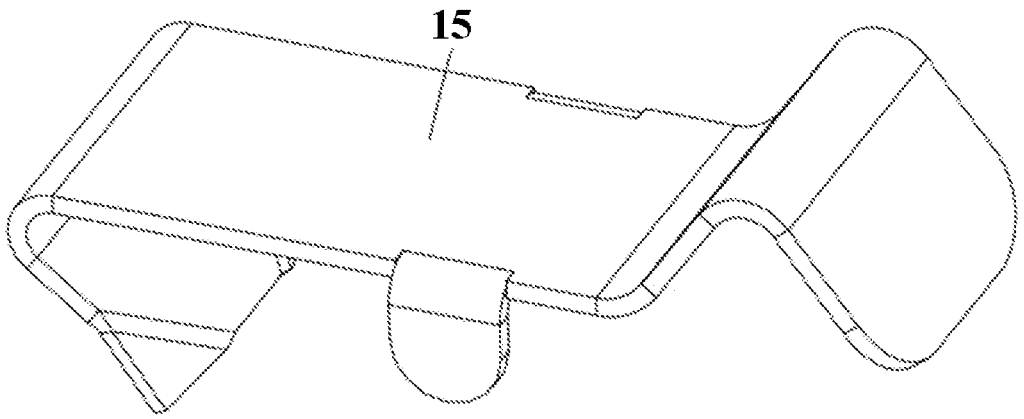
FIG. 3 is a schematic diagram of an elastic part in Example 1.
Figure 4:
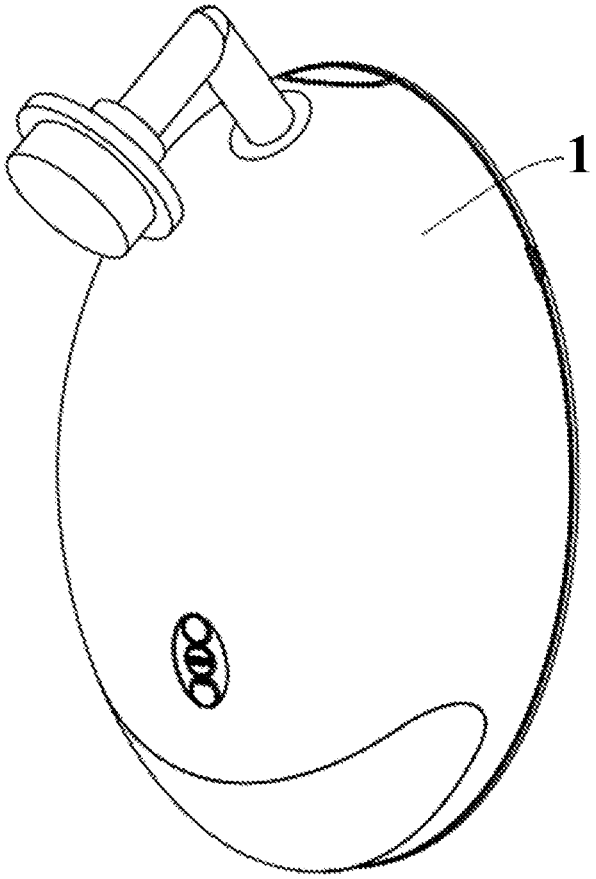
FIG. 4 is a schematic diagram of an emergency lamp in Example 1.

In the drawings, the following reference numbers are used: 1. Housing assembly; 11. Hole; 12. Front shell; 13. Rear cover; 14. Stand; 15. Elastic part; 16. Test button; 17. Light pipe; 18. Recess; 19. Connection hole; 2. Battery module; 21. Bracket; 22. Battery; 23. Cladding layer; 24. Rapid coupler; 3. Control panel; 31. Connector; 4. Lighting assembly; 5. Heat sink; 6. Light guide assembly; 61. Lens; 62. Reflector; 7. Transparent cover; 8. Sensing module; 81. First fastener; 82. Second fastener.

DETAILED DESCRIPTION

To further illustrate, embodiments detailing an emergency lamp are described below. It should be noted that the following embodiments are intended to describe and not to limit the disclosure.

Example 1

Referring to FIGS. 1-5, the disclosure provides an emergency lamp comprising a housing assembly 1; a battery module 2 comprising a bracket 21, a battery 22 disposed on the bracket 21, and a cladding layer 23 wrapping around the battery; a control panel 3; a lighting assembly 4; a light guide assembly 6; and a transparent cover 7. The housing assembly 1 is a hollow structure, and the battery module 2, the control panel 3, and the lighting assembly 4 are disposed in the housing assembly 1; the light guide assembly 6 is connected to the lighting assembly 4; the transparent cover 7 is disposed on the housing assembly 1; the position of the transparent cover 7 corresponds to that of the light guide assembly 6; the battery module 2 is electrically connected to the control panel 3, and the lighting assembly 4 is electrically connected to the control panel 3. In this example, the lighting circuit, drive circuit, control circuit and emergency circuit are integrated with the control panel 3, which is convenient to assemble. A waterproof ring is disposed between the transparent cover 7 and the housing assembly 1, and the protection grade of the waterproof ring reaches ingress protection 65 (IP65), so that the emergency lamp can be installed and used indoors and outdoors.

The battery module 2 comprises a bracket 21, a battery 22 disposed on the bracket 21, and a cladding layer 23 wrapping around the battery.

In this example, the cladding layer 23 is a heating and thermal insulation layer, for example, an electrothermal film. The control panel 3 cam specially control the heating of the battery 22. When alternating current is available, the electrothermal film heats the battery 22 through the mains supply. In case of power failure, the battery supplies power to the electrothermal film and the electrothermal film directly heats the battery 22, so that the emergency lamp can be used in a low-temperature environment, for example, between −50° C. and 5° C. Optionally, the heating and thermal insulation layer can also be provided with a heating film and an insulation layer (such as insulation cotton) at the same time, which can be used flexibly according to the ambient temperature. In addition, if the emergency lamp is not used in low temperature areas, the heating and thermal insulation layer is not necessarily disposed.

The lighting assembly 4 comprises a stand 41 connected to the housing assembly 1 and a light source 42 disposed on the stand 41. The light source 42 adopts a high-power LED lamp or lamp assembly, thus ensuring the illumination brightness. The light source 42 has a color temperature adjustment function. A color temperature adjustment module is disposed on the control panel 3 in advance, optionally, with three modes: warm color (2700-3300 K), natural color (3500-4500 K) and cold color (5000-6000 K). In use, appropriate color temperature can be adjusted as needed. In addition, according to the use requirements, the color temperature mode of the light source can be further redefined and divided into more color temperature modes.

The housing assembly 1 comprises a front shell 12, a rear cover 13, and a bottom support 14 disposed on the rear cover and facing the front shell 12; the front shell 12 comprises an inner wall and a plurality of elastic parts 15 is disposed on the inner wall; the rear cover 13 is connected to the front shell 12 through the plurality of elastic parts 15; and the battery module 2 is connected to the front shell 12. The rear cover 13 is connected to the front shell 12 through the plurality of elastic parts 15, which facilitates the assembly and opening of the housing assembly. Optionally, the elastic parts 15 are an elastic piece, one end of which is connected to the front shell 12, and the other end is bent to form a protrusion. The protrusion is clamped into a preset groove of the rear cover thus achieving the clamping connection. The elastic parts 15 are evenly disposed along the edge of the inner wall of the front shell 12, and the rear cover comprises a plurality of grooves equal to the elastic parts in number. When the front shell 12 and the rear cover are combined, all the elastic parts 15 on the front cover are clamped into the grooves on the rear cover to form an integrated structure. Optionally, the plurality of grooves is disposed on the front shell 12, and the elastic parts 15 are disposed on the rear cover, or, the grooves and the elastic parts 15 are both disposed on the front shell 12 and on the rear cover, which can be flexibly selected according to specific needs. In addition, the front shell and rear cover can also be locked by screws thus preventing intentional opening of the housing assembly.

The housing assembly 1 comprises a hole 11 for fixing a waterproof joint. In this example, the bottom and the side of the rear cover 13 are provided with the holes 11, respectively, so that the wiring can be carried out reasonably according to different use conditions. When one of the holes 11 is blocked, another hole 11 can be used, so as to flexibly adapt to different installation methods and installation conditions. In addition, a plurality of hanging holes are disposed at the bottom of the rear cover; the hanging holes are matched with corresponding hooks, which are especially suitable for outdoor installation of the emergency lamp. Optionally, a waterproof ring is disposed between the front shell 12 and the rear cover, and the protection grade of the waterproof ring reaches ingress protection 65 (IP65), so that the emergency lamp can be installed and used indoors and outdoors. Thus, the emergency lamp can flexibly adapt to the installation and use of various environments with different installation angles and installation methods.

The stand 41 of the lighting assembly 4 is clamped with the front shell 12 of the housing assembly 1. The side of the stand 41 facing the front shell 12 is provided with two clamping parts (not shown in the drawings), which can be clamped into the preset clamping holes of the front shell 12.

The front shell comprises a test button 16 and a light pipe 17; and the test button 16 is connected to the control panel. The light pipe 17 can guide the light of the indicator light on the control panel 3 to the outside for confirmation by an operator. The test button 16 extends to the control panel 3 and is connected to a test switch on the control panel 3. When the test button 16 is pressed, the test switch is triggered. In this example, the light pipe 17, the test button 16 and the counter screw are disposed in the same area.

The front shell comprises a recess 18, and the lighting assembly 4, the light guide assembly 6, and the transparent cover 7 are disposed in the recess 18.

In the example, the recess 18 is disposed near one side of the front shell 12, and when the transparent cover is installed in the recess, the transparent cover and the front shell form an integral arc surface. This integrated design can ensure that the luminous components will not stick to dust and can be self-cleaned by rainwater in outdoor environment for a long time use.

The light guide assembly 6 comprises a lens 61 and a reflector 62 both disposed on the stand 41; the lens 61 covers the light source 42, and the reflector 62 surrounds the lens 61. Specifically, the reflector 62 comprises a through hole, and the lens 61 passes through the through hole, so that the reflector 62 surrounds the lens 61. The light passing through the lens 61 is reflected to the outside by the reflector 62. The optical combination of the lens 61 and the reflector 62 can make full use of the light emitted by the lamp, increase the light emergence angle, thus providing a large installation space for the lamp, so as to reduce the number of the emergency lamps installed within a certain distance, reduce the use cost, and avoid the waste of the lamp light scattering on the wall, on the horizontal line or towards the sky.

The emergency lamp further comprises a heat sink 5 configured for heat dissipation for the lighting assembly; one end of the heat sink is connected to the lighting assembly 4, and the other end is connected to the housing assembly 1. High-power LED will produce lot of heat, so the arrangement of the heat sink 5 can enhance the heat dissipation effect and avoid overheating of the LED. In this example, the heat sink 5 is an L-shaped heat pipe, one end of which is connected to the lighting assembly 4, and the other end is connected to the inner wall of the front shell 12. Thus, the heat can be dissipated through the front shell 12, thus increasing the heat dissipation area and lightening the emergency lamp. Optionally, the shape of the heat sink 5 is not limited to the shape shown in the attached drawings of the disclosure, and can be adaptively selected as needed. Optionally, in actual use, if the power of the lighting lamp is small and its own heat dissipation can meet the normal use, the heat sink is not necessarily provided.

The battery module 2 further comprises a quick coupler 24 connected to the control panel 3, and the control panel 3 comprises a connector 31 connected to the quick coupler 24, thus facilitating the connection of the battery module and the control panel.

The emergency lamp further comprises a sensing module 8 disposed on the housing assembly 1; the sensing module 8 comprises a first fastener 81 and a second fastener 82 detachably connected to the housing assembly 1, and a sensor connected to the first fastener 81 and the second fastener 82; and the housing assembly 1 comprises a connection hole 19 to receive the second fastener 82. Specifically, the connection hole 19 is disposed on the front shell 12, and the second fastener 82 is disposed in the connection hole 19 in a threaded manner.

The sensor can use a light sensor to sense the intensity of light and feed the intensity back to the control chip of the control panel 3. The control panel 3 can flexibly adjust the output power of the lighting assembly 4 according to the feedback parameters. Optionally, the sensor is not limited to the shape shown in the above examples or diagrams, and can be selected according to specific needs. For example, a passive infrared (PIR) human body sensor or microwave radar human body sensor is adopted. When using a sensor sensing a human body, the emergency lighting lamps can automatically light up when someone passes by.

Example 2

Figure 5:
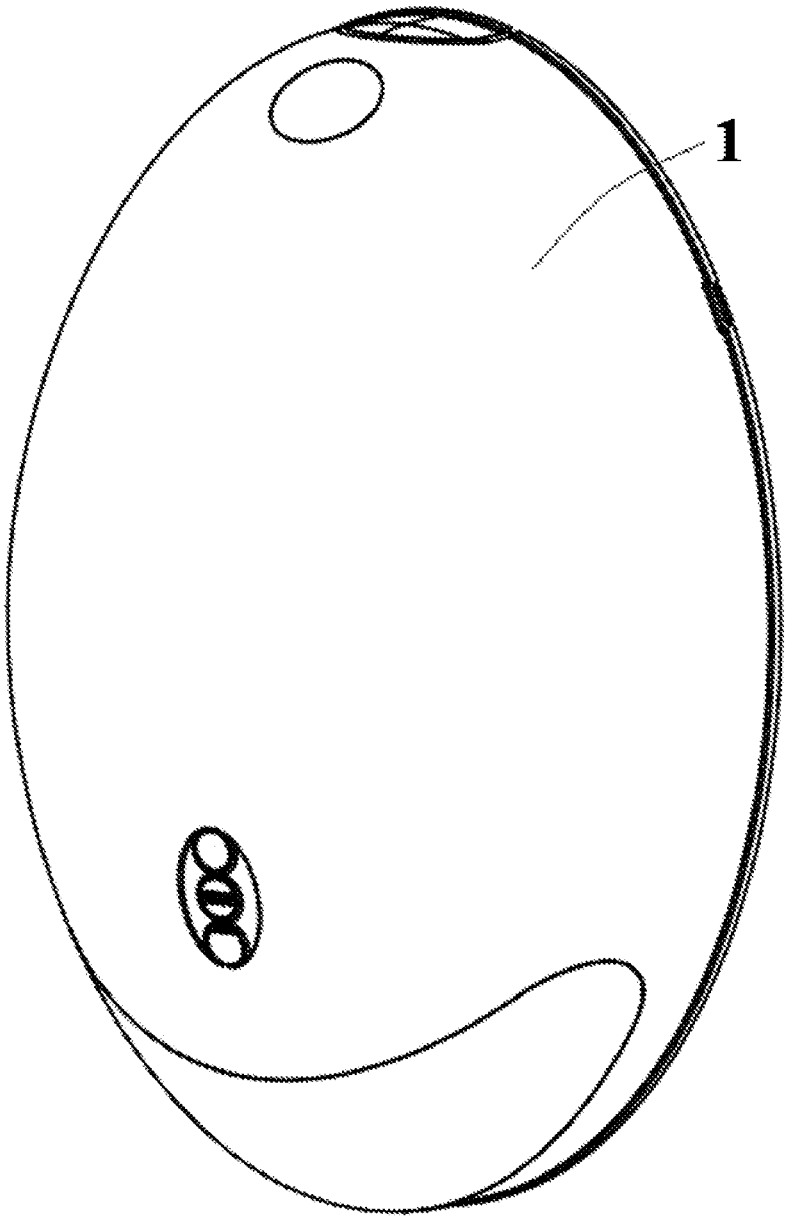
FIG. 5 is a schematic diagram of an emergency lamp in Example 2.

As shown in FIG. 5, the emergency lamp excludes the sensing module 8 in Example 1. The connection hole 19 is blocked, thus ensuring the watertightness. The emergency lamp of the example can be applied to places where the light control function is not required. The structure of other parts of the emergency lamp is the same as that in Example 1, and will not be described here.

The battery module 2, the control panel 3, the lighting assembly 4, and the light guide assembly 6 are disposed in the housing assembly 1, which can not only ensure good lighting effect, but also meet the installation and use requirements in different indoor and outdoor conditions or low temperature environments, with flexible use and wide application. The battery module 2 comprises a cladding layer 23 wrapping around the battery. When alternating current is available, the electrothermal film heats the battery 22 through the mains supply. In case of power failure, the battery supplies power to the electrothermal film and the electrothermal film directly heats the battery 22, so that the emergency lamp can be used in a low-temperature environment. The emergency lamp comprises a heat sink 5 configured for heat dissipation for the lighting assembly 4, thus ensuring the illumination effect thereof. The light guide assembly 6 can make full use of the light emitted by the lamp, increase the light emergence angle, thus providing a large installation space for the lamp. The housing assembly 1 comprises a hole 11 for fixing a waterproof joint, so that the wiring can be carried out reasonably according to different use conditions.

It will be obvious to those skilled in the art that changes and modifications may be made, and therefore, the aim in the appended claims is to cover all such changes and modifications.

What is claimed is:

1. An emergency lamp, comprising:

a housing assembly;

a battery module comprising a bracket, a battery disposed on the bracket, and a cladding layer;

a control panel;

a lighting assembly;

a heat sink configured for heat dissipation for the lighting assembly;

a light guide assembly; and a transparent cover;

wherein:

the housing assembly is a hollow structure, and the battery module, the control panel, and the lighting assembly are disposed in the housing assembly;

the light guide assembly is connected to the lighting assembly;

the transparent cover is disposed on the housing assembly;

a position of the transparent cover corresponds to that of the light guide assembly;

the battery module is electrically connected to the control panel, and the lighting assembly is electrically connected to the control panel;

the housing assembly comprising a hole for fixing a waterproof joint;

the cladding layer is wrapped around the battery;

the cladding layer is disposed on and connected to the battery; and the cladding layer is adapted to heat the battery and to ensure activation of the battery and normal operation of the emergency lamp in the temperature range between −50° C. and 5° C.

2. The emergency lamp of claim 1, wherein the lighting assembly comprises a stand connected to the housing assembly and a light source disposed on the stand.

3. The emergency lamp of claim 2, wherein the housing assembly comprises a front shell, a rear cover, and a bottom support disposed on the rear cover and facing the front shell; the front shell comprises an inner wall and a plurality of elastic parts is disposed on the inner wall; the rear cover is connected to the front shell through the plurality of elastic parts; and the battery module is connected to the front shell.

4. The emergency lamp of claim 3, wherein the front shell comprises a test button and a light pipe; and the test button is connected to the control panel.

5. The emergency lamp of claim 3, wherein the front shell comprises a recess, and the lighting assembly, the light guide assembly, and the transparent cover are disposed in the recess.

6. The emergency lamp of claim 2, wherein the light guide assembly comprises a lens and a reflector both disposed on the stand; the lens covers the light source, and the reflector surrounds the lens.

7. The emergency lamp of claim 1, wherein the heat sink is a heat pipe, one end of the heat sink is connected to the lighting assembly, and the other end is connected to the housing assembly.

8. The emergency lamp of claim 1, wherein the battery module further comprises a quick coupler connected to the control panel, and the control panel comprises a connector connected to the quick coupler.

9. The emergency lamp of claim 1, further comprising a sensing module disposed on the housing assembly; wherein the sensing module comprises a fastener detachably connected to the housing assembly, and a sensor connected to the fastener; and the housing assembly comprises a connection hole to receive the fastener.

10. The emergency lamp of claim 1, wherein the cladding layer is a heating and thermal insulation layer.

* * * * *